United States Patent [19]

Davis et al.

[11] Patent Number: 4,989,120

[45] Date of Patent: Jan. 29, 1991

[54] ENHANCED LIGHTING FOR ORNAMENTS

[75] Inventors: Terrill M. Davis, Gladstone; Charles J. Flynn, Kansas City; Jerry L. Knipp, Independence, all of Mo.

[73] Assignee: Hallmark Cards, Inc., Kansas City, Mo.

[21] Appl. No.: 475,186

[22] Filed: Feb. 5, 1990

[51] Int. Cl.[5] ..... F21V 21/30

[52] U.S. Cl. ..... 362/35; 362/124; 362/806; 362/808; 40/540

[58] Field of Search ..... 362/35, 806, 808, 124, 362/249, 125; 40/540

[56] References Cited

U.S. PATENT DOCUMENTS

| | | | |
|---|---|---|---|
| 1,700,328 | 1/1929 | Nicholson | 362/808 |
| 3,389,248 | 6/1968 | Abrams | 362/806 |
| 4,682,079 | 7/1987 | Sanders et al. | 362/806 |

*Primary Examiner*—James C. Yeung

[57] ABSTRACT

An ornament has a viewing chamber with transparent walls for displaying an ornamental object enhanced by a lamp that rotates with it. The mechanism for rotating the ornamental object is contained within a concealing chamber with opaque walls and includes a pair of brushes providing sliding contact with a pair of slip rings in electrical contact with the lamp. The slip rings rotate with the ornamental object to supply current to the lamp throughout the 360 degrees of rotation.

9 Claims, 2 Drawing Sheets

FIG. 3
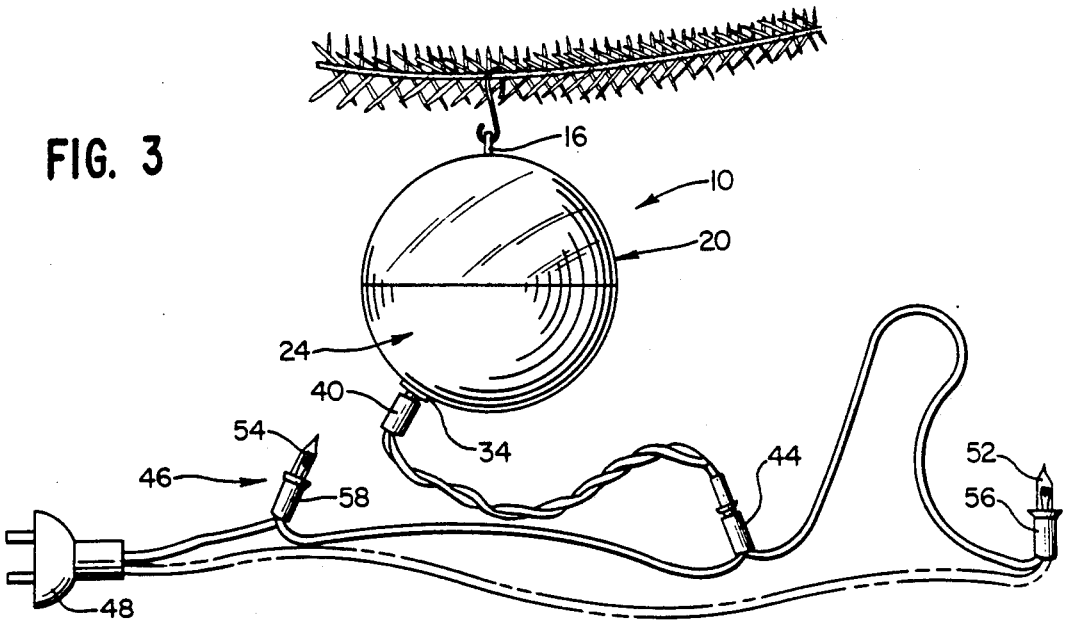
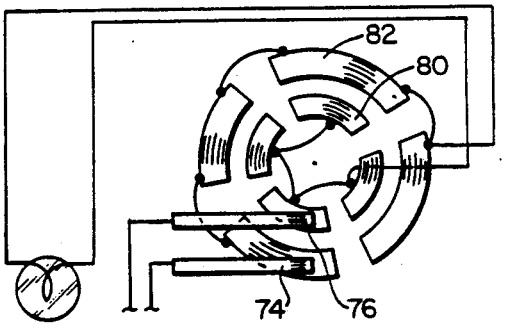
FIG. 5
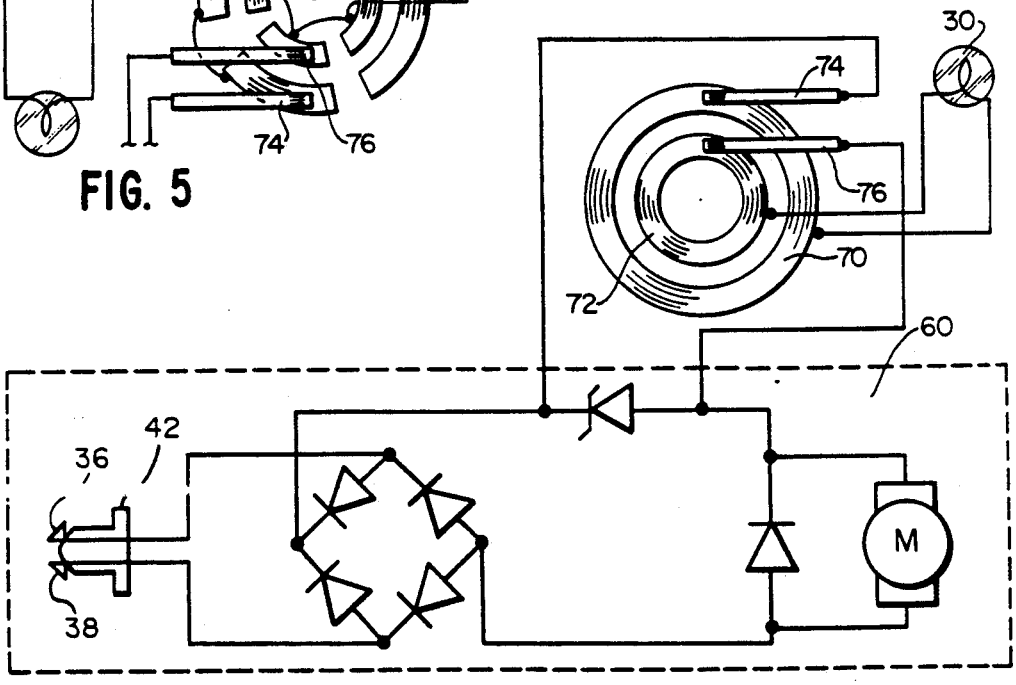
FIG. 4

ENHANCED LIGHTING FOR ORNAMENTS

BACKGROUND OF THE INVENTION

1. Field of the Invention

This invention relates to rotating ornaments and more particularly to small tree ornaments or the like which have lights and electrically energizable musical and/or motion producing devices which cooperate to produce highly attractive sensory effects. The ornaments of the invention are easily hung on trees or other supports and connected to a socket of a string of lights and they are safe and highly reliable while being readily and economically manufacturable.

2. Description of the Prior Art

There are many ornaments that derive at least part of their attractive sensory effects from electric lights or other electrically engergizable devices. One example of such an ornament can be found in U.S. Pat. No. 4,682,079 which is assigned to the same assignee as this application and which relates to ornaments for installation in a string of lights. These and other ornaments also employ rotation of ornamental elements to enhance their visual appeal.

A great many different types of lamps have been used or proposed in other technical areas but none of their structures render them suitable for implementation in ornaments designed to be hung on trees and connected in strings of lights, where it desirable to minimize manufacturing costs and to thereby minimize the cost to a user, while at the same time insuring safe and reliable operation.

SUMMARY OF THE INVENTION

The invention was evolved with the general object of providing ornaments which produced enhanced visual effects and which operate in a simple manner allowing economical manufacture while being safe and reliable.

In accordance with the invention, an ornament is provided which realizes the foregoing objects and which includes a casing having a dividing wall that divides the casing into a viewing chamber that has transparent walls and a concealing chamber that has opaque walls. A rotatable ornamental member for producing attractive visual effects is disposed within the viewing chamber and is rotated by a motor disposed within the concealing chamber to be concealed from view.

A lamp or other electrically operated load device is disposed for rotation with the rotatable ornamental member and is energized through connections which are concealed from view and which are disposed in protected positions for maximum safety while being reliable in opeation. Such connections include first and second electrical contacts which are connected to the load device and which are disposed within the concealed chamber and supported from the ornamental member for rotation therewith. Third and fourth electrical contacts are connected to a source of energization and are supported within the concealing chamber in fixed relation to the outer casing. As the ornament rotates with respect to the casing, the third and fourth contacts slidably engage with the first and second contacts respectively.

The ornament is readily supported from the branch of a tree or other supporting object while being readily connected to a source of electrical power which may preferably be a socket of a string of lights. In accordance with a specific feature of the invention, suspension means extend upwardly from the top of the ornament, preferably in the form of a simple loop. The ornament is energized from a power supply which may preferably be an AC power supply provided by the light string. A further important feature is that the ornament is energizable through a pigtail connector device which is attached to one socket of the string of lights and which may preferably be connected a side portion of the concealing chamber of the ornament. Since the power source is an AC source, circuitry is included to provide a DC current to power the motor and load device. The load device may be any of a number of the possible load devices including a lamp, a motor driven object and a musical device.

A further feature of the construction is that it can be readily modified for various applications and modes of operation. Instead of a pair of unbroken rings, the first and second contacts may be broken rings that on rotation supply current to the load device intermittently. This type of arrangement is likely to be most desirable when the load device is a lamp as it enables the lamp to flash or flicker depending upon the interval between subsequent supplies of current.

BRIEF DESCRIPTION OF THE DRAWINGS

For a more complete understanding of this invention, reference should now be made to the embodiment illustrated in greater detail in the accompanying drawings and described by way of example only. In the drawings:

FIG. 3 is a perspective view of the ornament of FIG. 1 showing schematically the connection to a string or lights;

FIG. 4 is a schematic representation of the electric circuitry for supplying current to a light that forms part of the ornament.

FIG. 5 is a schematic representation showing an alternative arrangement of the slip rings of FIG. 4.

DESCRIPTION OF PREFERRED EMBODIMENTS

Figure 1:
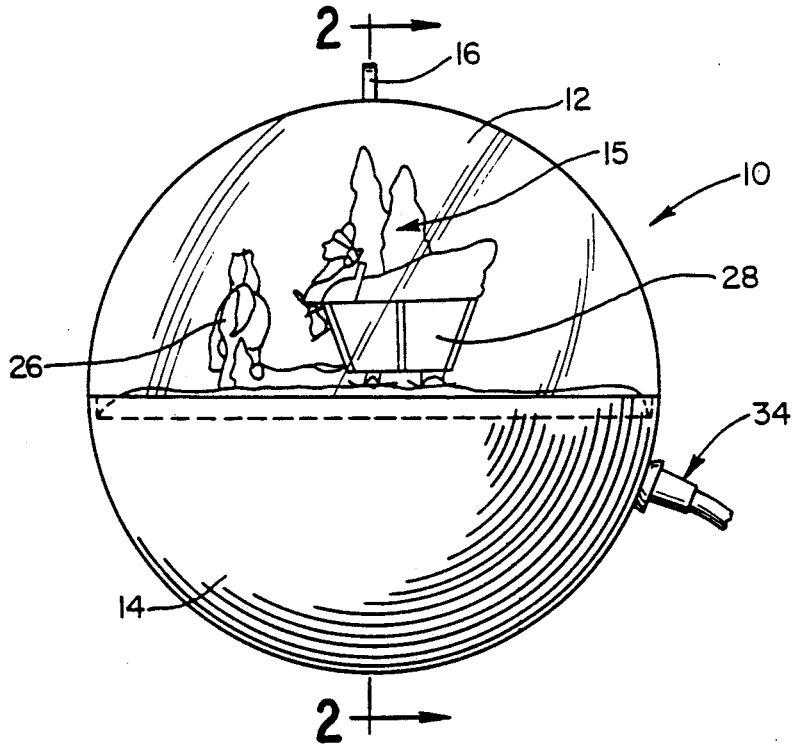
FIG. 1 is a perspective view of an ornament of this invention.
Figure 2:
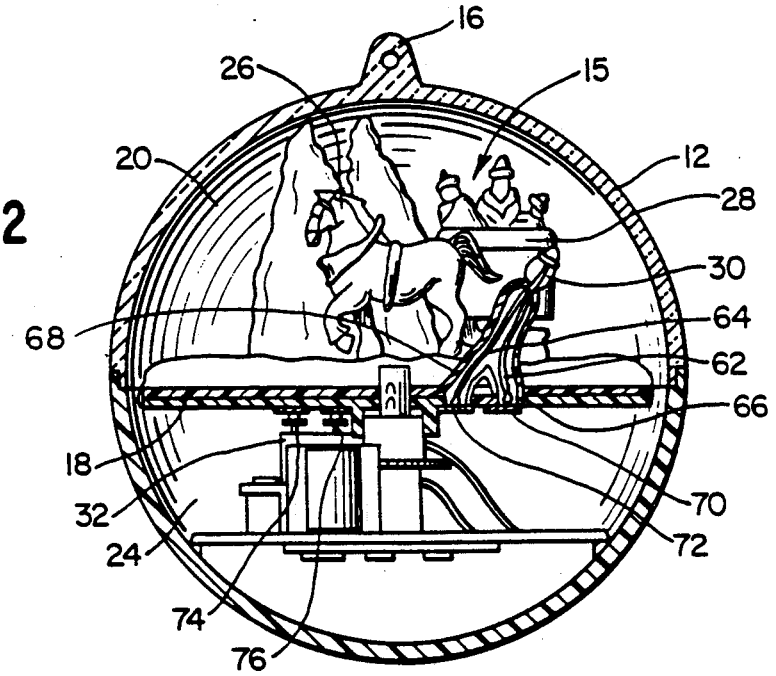
FIG. 2 is a section through the ornament of FIG. 1.

Turning to FIGS. 1 and 2, ornament 10 constructed in accordance with this invention is seen. The ornament 10 is formed in two parts, a hollow hemispherical upper housing member 12 that is transparent, and a hollow hemispherical lower housing member 14 that is opaque. The two housing members are joined together to form a hollow spherical housing for the display of an ornamental shape 15. The upper housing member 12 has a hanger 16 that allows the spherical housing to be hung from a tree or the like. A disc 18 divides the ornament into two chambers, a viewing chamber 20 and a concealing chamber 24.

The transparency of the upper housing 12 permits viewing of the horse 26 and sleigh 28 of the ornamental shape 15 situated in the viewing chamber 20. The sleigh 28 is lit by a lamp 30 that enhances the attractive visual effects of the ornament 10. The disc 18 rotates about a central axis 28 and with it rotates the horse 26, sleigh 28 and lamp 30. The concealed chamber, best seen in FIG. 2, contains a motor 32 for rotating the disc 18, and circuitry for providing a DC supply to both the motor 32 and the lamp 30.

A plug 34 is secured to the lower housing member 14 and has contacts 36 and 38 that form electrical power inputs for the ornament. The plug 34 is insertable into a socket 40 at one end of a pigtail connector device 42 that will allow the ornament to be plugged into one socket 44 of a string of lights 46. The string of lights 46 is connected to a plug 48 for connection to an external conventional 120-volt AC power source. The string may include many lights but only two lights 52, 54 and two sockets 56, 58 are shown in FIG. 3.

To provide the DC supply required by the motor and lamp, a circuit 60, shown schematically in FIG. 3 is used. The circuitry is located within the concealing chamber 24 and described in detail in issued U.S. Pat. No. 4,682,079 assigned to the same assignee as this application and incorporated herein by reference.

The lamp 30 is positioned on the sleigh 28 away from the axis of rotation of the disc 18. The wires 62, 64 supplying current to the lamp do not pass through a central aperture on the disc 18 but instead pass through a pair of apertures 66, 68 situated away from the center of rotation of the disc. Direct connection between the wires 62, 64 and the external power source would result in twisting and possible disconnection of the connection wires on rotation of the disc 18. In order to prevent this from happening, a pair of conducting rings 70, 72 are located on the underside of the rotating disc 18. The rings 70, 72 are in electrical contact with the wires 62, 64 respectively and insulated from one another. A pair of brushes 74, 76 insulated from one another make electrical contact between the rings 70, 72 and the circuit providing DC current. As the disc rotates, the brushes 74, 76 trace the paths of a pair of concentric circles that correspond to the rings 70, 72 located on the underside of the disc 18.

In operation AC current flows in the string of lights and is delivered to the ornament through the pigtail connector device 42. The circuit 60 converts the AC supply to a DC supply that feeds the motor 32 and the brush contacts 74, 76. The brushes 74, 76 make contact with the rings throughout the entire 360 degrees of rotation of the disc and ornament. The rings 70, 72, seen best in FIG. 4, are unbroken and therefore provide a continual supply of current to the lamp. The rings could, however, be selectively broken as those designated 80, 82 shown in FIG. 5. This configuration permits intermittent current to be supplied to the lamp 30 thereby causing the lamp to flicker or flash.

Although an illuminated ornament is illustrated in the FIGURES, the arrangement described is equal suited to the location of load devices other than lamps on the rotating disc. For example the ornament could incorporated a part that moves with respect to the rotating disc, for example a motor vehicle. Other motor operated devices could also be positioned on the ornament without restriction on the location of the contacts. Alternatively, a musical, or other load device, could also be attached to the ornament. There is virtually no limit to the different arrangements of ornament and load device that can be accomplished through the mechanism of this invention.

By providing a mechanism by which the ornament within the casing rotates while the exterior casing remains stationary relative to its surroundings, a simple loop fixture is sufficient to hang the ornament from a tree or the like. This allows the manufacture of the ornament to remain relatively straightforward and for costs to be kept within economically viable limits.

While one preferred embodiment of this invention is illustrated, it will be understood of course that the invention is not limited to this embodiment. Those skilled in the art to which the invention pertains may make modifications and other embodiments employing the principles of the invention, particularly upon considering the foregoing teachings.

What is claimed is:

1. An ornament adapted for connection in a string of light sockets on a tree and for hanging from a branch of the tree or other supporting object, said ornament comprising: a rotatable ornamental device including electrically energizable load means, a disc supporting said ornamental device and having an axis of rotation, a support and drive assembly including an electric motor and arranged for supporting said disc and said ornamental device for rotation about said axis of rotation and for effecting rotation thereof about said axis of rotation, a hollow outer housing supporting said support and drive assembly therewithin and surrounding said rotatable ornamental device, said outer housing having a transparent wall for viewing of said ornamental device and having an opaque wall surrounding said support and drive assembly, first and second contact means is slidable engagement, one of said first and second contact means being disposed on said disc and being connected to said electrically energizable load means, the other of said first and second contact means being carried by said support and drive assembly, an electrical connector on said opaque wall, means within said housing connecting said electrical connector to said electric motor and to said second contact means, means including a flexible cable for connecting said electrical connector to one socket of a string of light sockets on the tree, and suspension means extending upwardly from a top end of said housing for suspending said ornament from a suspension point on a branch of the tree, said flexible cable allowing flexibility in location of said suspension point and allowing said ornament to be moved by gravity to assume a position which is such as to provide a relatively stable orientation of said axis of rotation when said ornament is suspended from a branch of the tree.

2. An ornament as defined in claim 1, wherein said axis of rotation is substantially aligned with the center of gravity of said ornament and with said suspension means so as to be a substantially vertical axis.

3. An ornament as defined in claim 1, wherein said housing includes a first hollow housing member having said transparent wall and disposed in surrounding relation to said ornamental device, and a second hollow housing member having said opaque wall in surrounding relation to said support and drive assembly, said first and second hollow housing members being secured together in a plane in approximate alignment with said disc.

4. An ornament as defined in claim 3, wherein each of said first and second housing members is of generally hemispherical shape with said housing thereby having a generally spherical shape.

5. An ornament as defined in claim 1, wherein said first contact means include brush means and said second contact means include conductor means extending arcuately about said axis for engagement by said brush means.

6. An ornament as defined in claim 5, wherein said brush means of said first contact means are carried by said support and drive assembly, and wherein said conductor means of said second contact means are mounted on one side of said disc with said ornamental device being mounted on an opposite side of said disc.

7. An ornament as defined in claim 1, wherein said axis is substantially vertical and said disc is substantially in a horizontal plane, said ornamental device being mounted on an upper side of said disc, and said one of said contact means being mounted on a lower side of said disc.

8. An ornament as defined in claim 7, wherein said support and drive assembly and said electric motor thereof are in a lower portion of said housing.

9. An ornament as defined in claim 8, wherein said housing is formed by an upper housing member having said transparent wall and disposed in surrounding relation to said ornamental device, and a lower housing member having said opaque wall in disposed in surrounding relation to said support and drive assembly, said support and drive assembly and said disc and ornamental device carried therefrom being supported by said lower member.

* * * * *